US008365743B2

(12) United States Patent
Stotts

(10) Patent No.: US 8,365,743 B2
(45) **Date of Patent: *Feb. 5, 2013**

(54) TOOL FOR HAIR EXTENSION REMOVAL

(76) Inventor: Sheila G. Stotts, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/098,288

(22) Filed: Apr. 29, 2011

(65) Prior Publication Data

US 2011/0203603 A1 Aug. 25, 2011

Related U.S. Application Data

(63) Continuation of application No. 11/725,121, filed on Mar. 15, 2007, now Pat. No. 7,954,499.

(51) Int. Cl.
*A45D 24/22* (2006.01)

(52) U.S. Cl. ..... 132/112; 132/116

(58) Field of Classification Search ..... 132/112–116, 132/109, 126, 125; 401/265, 9, 10
See application file for complete search history.

(56) References Cited

U.S. PATENT DOCUMENTS 3,818,917 A * 6/1974 Hudson ..... 132/116
3,960,160 A * 6/1976 Hogan ..... 132/112
4,557,619 A 12/1985 DeVincentis
6,510,856 B1 * 1/2003 Ahn ..... 132/219
6,691,712 B2 2/2004 Chu et al.
2003/0131864 A1 * 7/2003 Lu ..... 132/108

OTHER PUBLICATIONS

International Search Report and Written Opinion in counterpart PCT application No. PCT/US2008/056155. dated Aug. 4, 2008.
Extended European Search Report in counterpart EP application No. 08 73 1622, dated Mar. 19, 2012.

* cited by examiner

*Primary Examiner* — Robyn Doan
(74) *Attorney, Agent, or Firm* — Chen Yoshimura LLP

(57) ABSTRACT

A hair extension removal tool is generally shaped like a pair of pliers with two jaws formed of two elongated members pivotally joined together. A body is attached to the first elongated member and houses a solvent container therein. A tubing extends from the container to an opening on an inside surface of one of the jaws. The container has a pump for ejecting an amount of the solvent through the tubing. A lever attached to the body is provided for activating the pump. In use, a strand of extension hair is placed within the jaws of the removal tool, the lever is pressed to eject an appropriate amount of the solvent through the tubing, and pressure is applied to the hair extension with the jaws of the tool to weaken the attachment, until the bonding material is sufficiently dissolved and the extension hair is detached and removed.

8 Claims, 1 Drawing Sheet

TOOL FOR HAIR EXTENSION REMOVAL

BACKGROUND OF THE INVENTION

1. Field of the Invention

This invention relates to a tool for removal of supplemental hair in hair extensions.

2. Description of the Related Art

Hair extensions are a technique by which strands of supplemental hair, either artificial hair or natural hair from other sources, are attached to strands of a subject's own hair to make the subject appear to have more or longer hair. Hair extensions are often used, for example, by performing artists or by others who desire to have certain appearances. There is often a need to remove the supplemental hair in hair extensions after a period of use.

SUMMARY OF THE INVENTION

The present invention is directed to a tool for hair extension removal that substantially obviates one or more of the problems due to limitations and disadvantages of the related art.

An object of the present invention is to provide an effective and easy to use tool for hair extension removal.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides a hair extension removal tool, which includes: a first and a second elongated member pivotally joined to each other, wherein a distal end of the first elongated member and a distal end of the second elongated member form first and second jaws capable of opening and closing as the first and second elongated members pivot with respect to each other; a body attached to the first elongated member; a container housed inside the body for containing a solvent; a tubing extending from the container to an opening on an inside surface of one of the first and second jaws, wherein the container includes an application mechanism for ejecting an amount of the solvent from the container through the tubing; and an activation mechanism attached to the body for activating the application mechanism to eject the solvent.

In another aspect, the present invention provides a method for using a hair extension removal tool, the tool including a first and a second elongated member pivotally joined to each other, a distal end of the first elongated member and a distal end of the second elongated member forming first and second jaws capable of opening and closing as the first and second elongated members pivot with respect to each other, a container attached to the first or second elongated member for containing a solvent, a tubing extending from the container to an opening on an inside surface of one of the first and second jaws, and an activation mechanism mechanically coupled to the container for ejecting an amount of the solvent from the container through the tubing , the method including: placing a strand of hair extension between the first and second jaws; pressing the activation mechanism to eject an amount of the solvent from the container; and applying a pressure to the strand of hair extension using the first and second jaws by pivoting the first and second elongated members with respect to each other, whereby a bonding material in the hair extension is dissolved and supplemental hair in the hair extension is detached.

It is to be understood that both the foregoing general description and the following detailed description are exemplary and explanatory and are intended to provide further explanation of the invention as claimed.

DETAILED DESCRIPTION OF THE PREFERRED EMBODIMENTS

In a common hair extension technique, strands of supplemental hair are attached to strands of the subject's own hair by a bonding material. To remove the supplemental hair, the bonding material must be sufficiently dissolved so that the supplemental hair is separated from the subject's own hair.

Figure 1:
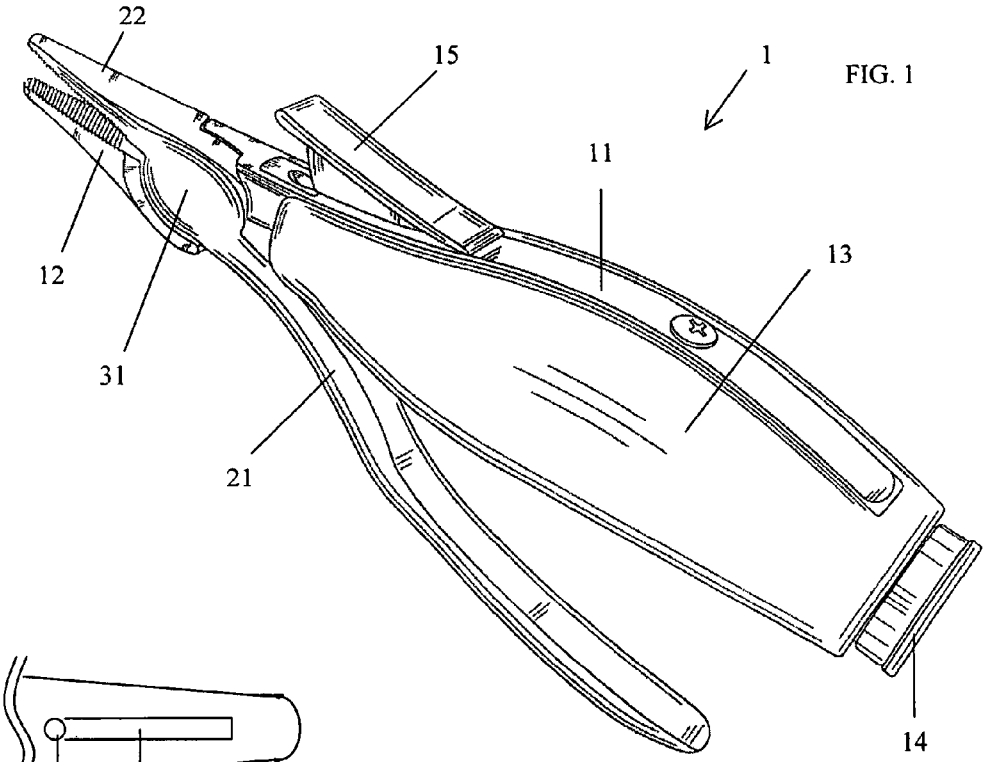
FIGS. 1 to 3 illustrate a hair extension removal tool according to an embodiment of the present invention.
Figure 3:
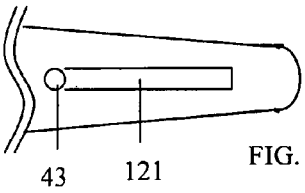

A hair extension removal tool according to embodiments of the present invention is described below with reference to FIGS. 1 to 3. As shown in FIG. 1, the hair extension removal tool 1 is generally shaped like a pair of pliers formed of two elongated members 11 and 21 pivotally jointed together at a pivot point 31. The distal ends of the two elongated members form two jaws 12 and 22 of the tool that can open and close when the elongated members 11 and 21 pivot with respect to each other. A body 13 is attached to the first elongated member 11 and forms the main part of a handle of the tool which is held in a user's hand when the tool is used. The body 13 may have any suitable exterior shape, but it is preferably designed to fit comfortably in the hand of the user.

Figure 2:
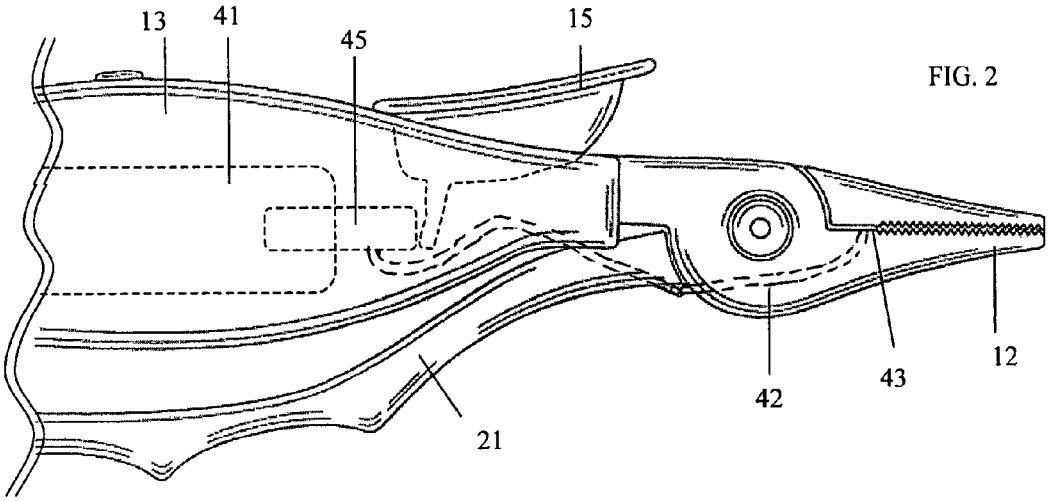

As shown in FIG. 2, a container 41 is housed within the body 13 to contain a solvent suitable for dissolving the bonding material used in the hair extension. The container 41 is preferably a separate container, or it may also be formed by the inner surface of the body 13 itself. An opening is provided at the end of the body 13 with a lid 14 for re-supplying the solvent and/or replacing the container. A tubing 42 in fluid communication with the container 41 extends from the container to an opening 43 on the inside surface of the first (lower) jaw 12. Passages (not shown) are provided in the body 13, the second elongated member 21 and the first elongated member 11 to allow the tubing 42 to extend therethrough. Alternatively, the tubing 42 and opening 43 may be located on the inside surface of the second (upper) jaw 22, or on both jaws. A pressing lever 15 is pivotally attached to the body 13 to control an application mechanism (e.g. a pump) 45 of the container 41 disposed inside the body. When the lever 15 is pressed, the application mechanism (pump) 45 is activated to eject an amount of solvent in the container 41 through the tubing 42 and the opening 43 in the form of a fine stream or spray. As an alternative to the lever 15, a push button, finger trigger or other type of activation mechanism may be used. As shown in FIG. 2, the pump 45 may include a spring-biased plunger 45*a* which is pushed by the lever (the activation mechanism) 15. Application mechanisms for ejecting a liquid from a container are well known in the field of spray bottle design. Any suitable designed may be used for the application mechanism 45 and its structure is only schematically illustrated in FIG. 2 and further details are omitted here.

Mating patterns of fine grooves are preferably formed on the inside surfaces of the jaws to more effectively engage the hair being worked on. The jaws are shaped such that when the tool is in a closed state, the inside surfaces of the first and second jaws come into close proximity with each other but do not come into actual contact. This eliminates a common problem of hair breakage in conventional hair extension removal tools. In addition, as schematically illustrated in FIG. 3, one or more longitudinal channels 121 are formed on the inside surface of the first (lower) jaw 12. When the tool is in use, the solvent may pool in the channel(s) 121. Advantages of the pooling of solvent in the channel(s) include reducing in the amount of solvent needed, improving in the dissolving process as solvent is pooled at the site of the bonding material, and preventing the solvent from running down the hair which reduces dry hair and brittleness. In operation, a strand of the hair extension is held with one hand of the user so that the segment where the supplemental hair is jointed to the subject's own hair is located within the jaws of the removal tool, which is held in another hand of the user. With the jaws either open or closed, the lever 15 is pressed, for example, with the thumb or index finger of the user, to eject an appropriate amount of the solvent from the container 41 through the tubing 42 which has its end located near the opening 43 on an inside surface of a jaw. The solvent is thus applied to the joined segment of the hair extension where the bonding material is present. Excess solvent, if present, will pool in the channel(s) 121 in the lower jaw 12. The user then applies pressure to the joined segment of the hair extension with the jaws of the tool to weaken the attachment, while repeatedly applying the solvent when appropriate, until the bonding material is sufficiently dissolved and the supplemental hair is detached and removed from the subject's own hair. Using the hair removal tool, the hair extension is removed one or more strands at a time.

It will be apparent to those skilled in the art that various modification and variations can be made in the hair extension removal tool of the present invention without departing from the spirit or scope of the invention. Thus, it is intended that the present invention cover modifications and variations that come within the scope of the appended claims and their equivalents.

What is claimed is:

1. A hair extension removal tool comprising:

a first and a second elongated member pivotally joined to each other, a distal end of the first elongated member and a distal end of the second elongated member forming first and second jaws capable of opening and closing as the first and second elongated members pivot with respect to each other, the first and second jaws each having an inside surface, wherein when the tool is in a closed state, the inside surfaces of the first and second jaws are parallel to each other and come into close proximity with each other but without coming into actual contact to define an air gap in between;

a body attached to the first elongated member;

a container housed inside the body for containing a solvent;

a tubing extending from the container to an opening located on the inside surface of one of the first and second jaws, wherein the container includes an application mechanism for ejecting an amount of the solvent from the container through the tubing and the opening; and an activation mechanism attached to the body for activating the application mechanism to eject the solvent, wherein the inside surface of the first jaw defines one or more channels extending in a longitudinal direction of the first jaw for pooling the solvent ejected from the opening.

2. A hair extension removal tool comprising:

a first and a second elongated member pivotally joined to each other, a distal end of the first elongated member and a distal end of the second elongated member forming first and second jaws capable of opening and closing as the first and second elongated members pivot with respect to each other, the first and second jaws each having an inside surface, the inside surfaces of the first and second jaws facing each other when the first and second jaws are in a closed state;

a container attached to the first or second elongated member for containing a solvent;

a tubing extending from the container to an opening located on an inside surface of one of the first and second jaws; and an activation mechanism mechanically coupled to the container for ejecting an amount of the solvent from the container through the tubing and the opening, wherein the inside surface of the first jaw defines one or more channels extending in a longitudinal direction of the first jaw for pooling the solvent ejected from the opening.

3. The hair extension removal tool of claim 2, wherein the body and the first and second elongated members define a passage for the tubing.

4. The hair extension removal tool of claim 2, wherein the application mechanism includes a pump.

5. The hair extension removal tool of claim 2, wherein the activation mechanism includes a lever.

6. The hair extension removal tool of claim 2, wherein the inside surfaces of the first and second jaws are provided with mating patterns of grooves.

7. The hair extension removal tool of claim 2, wherein the body has an opening with a lid for re-supplying the solvent or replacing the container.

8. A method of using a hair extension removal tool, the tool comprising a first and a second member moveably disposed relative to each other, a first end of the first member and a first end of the second member forming first and second jaws capable of opening and closing as the first and second members move with respect to each other, a container attached to the first or second member for containing a solvent, a tubing extending from the container to an opening on an inside surface of one of the first and second jaws, wherein the inside surface of the first jaw defines one or more channels extending in a longitudinal direction of the first jaw, and an activation mechanism mechanically coupled to the container for ejecting an amount of the solvent from the container through the tubing, the method comprising:

placing a strand of hair extension between the first and second jaws;

pressing the activation mechanism to eject an amount of the solvent from the container through the opening of the tubing;

allowing some of the ejected solvent to pool in the longitudinal channels; and applying a pressure to the strand of hair extension using the first and second jaws by moving the first and second elongated members with respect to each other, whereby a bonding material in the hair extension is dissolved and supplemental hair in the hair extension is detached.

* * * * *